United States Patent [19]

Hirabayashi

[11] 4,352,271

[45] Oct. 5, 1982

[54] STEAM FEEDING APPARATUS FOR A MULTICYLINDER STEAM ENGINE

[75] Inventor: Yuji Hirabayashi, Yokohama, Japan

[73] Assignee: Nissan Motor Co., Ltd., Yokohama, Japan

[21] Appl. No.: 101,242

[22] Filed: Dec. 7, 1979

[30] Foreign Application Priority Data

Dec. 22, 1978 [JP] Japan ..... 53-174855[U]

[51] Int. Cl.[3] ..... F01K 21/00

[52] U.S. Cl. ..... 60/670; 60/657; 91/418

[58] Field of Search ..... 60/643, 645, 646, 657, 60/670; 137/883; 91/418

[56] References Cited

U.S. PATENT DOCUMENTS 1,673,476 6/1928 Wintzer ..... 60/657 X

*Primary Examiner*—Allen M. Ostrager

[57] ABSTRACT

In a multicylinder steam engine, separate steam feed conduits between a steam distributor and steam inlet valves of the cylinders and a large volume steam chamber adjacent to an inlet of the inlet valves respectively to suppress a pressure pulsation in the feed conduits.

4 Claims, 3 Drawing Figures

STEAM FEEDING APPARATUS FOR A MULTICYLINDER STEAM ENGINE

BACKGROUND OF THE INVENTION

The present invention relates to a steam feeding apparatus for a multicylinder steam engine including a steam distributor and steam feed conduits each connected with a respective cylinder.

In such a multicylinder steam engine, a steam generator and the engine body must be connected with each other such that some relative movements are allowed to absorb vibration. Thus, steam feed conduits connecting the steam generator and the engine body have to be made of thin material to absorb the vibration. Consequently, a large diameter conduit cannot be used, and small diameter feed conduits are used to connect the steam generator and cylinders of the engine, respectively.

According to this limitation, conventionally, a steam distributor acting as a steam reservoir is mounted adjacent the steam generator, and the feed conduits are connected between the distributor and upstream portions of inlet valves of the cylinders, respectively. Such a construction accompanies a serious problem relating to the throttle resistance in the slender feed conduits. Especially, at high rotational speed range, output increase is disturbed by the pressure pulsation at the entrance of the inlet valves and by the throttle resistance in the feed conduits.

In order to overcome the above-mentioned disadvantages, it has been proposed to select the length of the feed conduits between the steam distributor and the cylinders in such a manner that the conduits act as resonance pipes capable of improving the steam charging efficiency. However, such resonance pipes are effective for a narrow range of engine revolution only, and in many cases, the resonance pipes cannot be accommodated in a limited space of the engine room of vehicles.

SUMMARY OF THE INVENTION

An object of the present invention is to provide a multicylinder steam engine having an improved charging efficiency.

According to the present invention, there is provided a multicylinder steam engine having an engine body which is relatively movably connected with a steam generator through steam feed conduits which are connected with the cylinders of the engine respectively, characterized by a steam chamber of sufficient volume formed adjacent to each inlet valve of the cylinder and communicating with each steam feed conduit to suppress pressure pulsation in the steam feed conduit.

According to a preferred embodiment of the present invention, the steam chamber is formed as a communication tube which communicates two or more steam feed conduit with each other.

By forming a large volume steam chamber, according to the present invention, an efficient steam reservoir is formed which suppresses pressure pulsation and gas column vibration in the steam feed conduits. Consequently, charging efficiency is improved throughout the whole speed range of the engine.

Also, by forming the steam chamber as a communication tube which communicates two or more steam feed conduits with each other, the communication tube feeds steam to the cylinders alternately. Thus, the communication tube acts efficiently as a steam reservoir and all the steam feed conduits which are connected with the tube feed steam to the cylinders one by one. Consequently, charging efficiency is remarkably improved.

DETAILED EXPLANATION OF THE PREFERRED EMBODIMENTS

Figure 1:
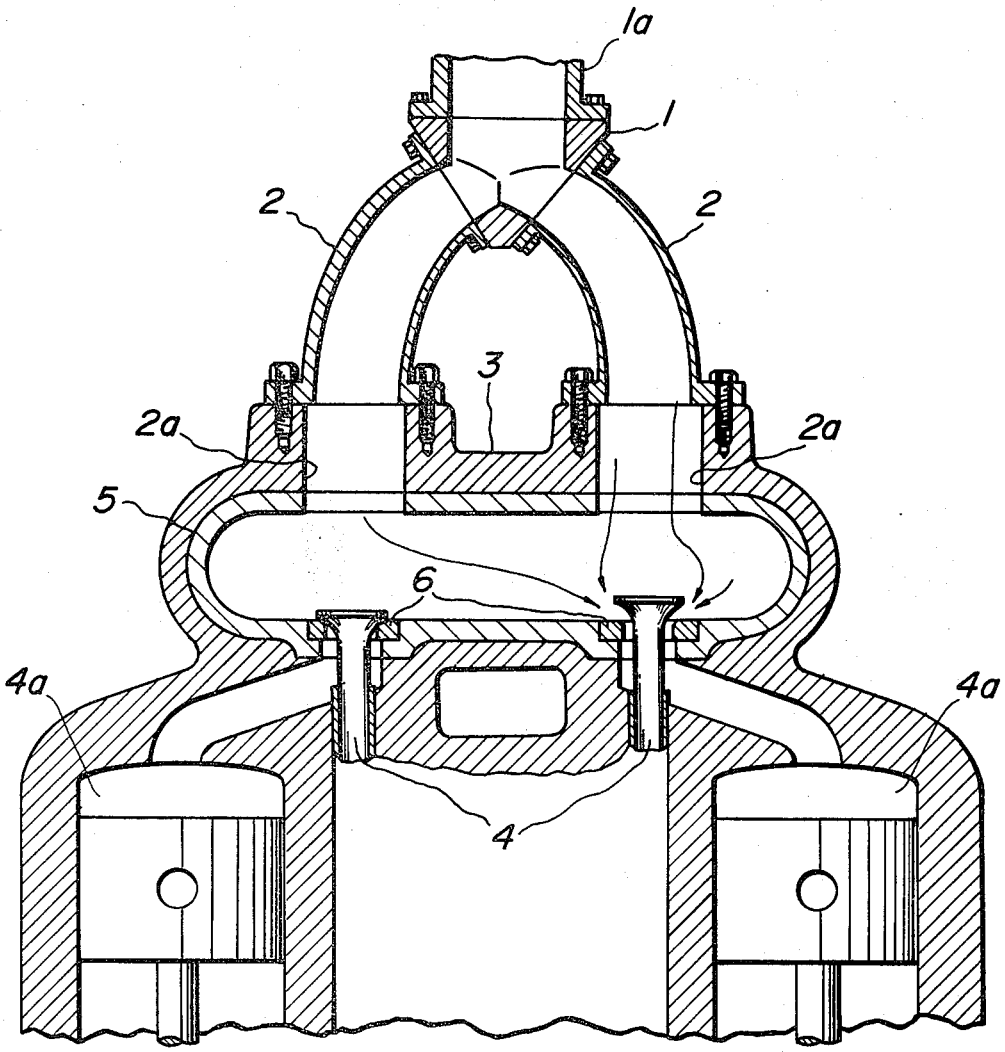
FIG. 1 is a schematic longitudinal sectional view of a portion of a steam engine, according to one embodiment of the present invention.

Referring to FIG. 1, reference numeral 1 designates a steam distributor which is securely connected with a steam generator 1*a*. Steam feed conduits 2, 2 are connected between the steam distributor 1 and a cylinder head 3, and feed steam to inlet valves 4, 4 of engine cylinders 4*a*, respectively.

A communication tube 5 is integrally cast into the cylinder head 3, according to the present invention. The communication tube 5 is made of heat-resisting and pressure-resisting material which may be high strength cast steel, but which is different from the material forming the cylinder head 3. The communication tube 5 has openings 2*a*, 2*a* which communicate with the steam feed conduits 2, 2, respectively. Valve seats 6, 6 are pressed around the corresponding openings on the inner surface of the communication tube 5. The valve seats 6, 6 engage with the inlet valves 4, 4 of the cylinders, respectively. The volume of the communication tube 5 is selected to be more than one half of the total displacement of the relevant cylinders to form a steam reservoir.

As the communication tube 5 is common to the cylinders or inlet valves 4, 4 and forms a steam reservoir disposed adjacent to the inlet valves 4, 4, pressure pulsation at each inlet of the inlet valves is suppressed. Accordingly, gas column vibration is minimized and charging efficiency is improved.

Since the communication tube 5 is common to the steam feed conduits 2, 2 and the inlet valves 4, 4, and one of the inlet valves 4, 4 opens at one time, steam stored in the tube 5 flows into the inlet valves 4, 4 alternately. Steam is fed into the communication tube 5 continuously through the two feed conduits 2, 2. Because the overall cross-sectional area of the feed conduits 2, 2 for a single steam reservoir is substantially increased, the maximum flow speed of the steam in the feed conduits is decreased accordingly. Due to this, throttle resistance of each feed conduit is decreased resulting in an improvement of the steam charging efficiency.

By integrally securing the communication tube 5 within the cylinder head 3, the communication tube 5 is capable of withstanding the desired high temperature and high pressure of steam. Thus, the steam reservoir can be formed adjacent to the inlet valves 4, 4 even when the operating pressure and temperature exceed durable limits of the material forming the cylinder head 3.

Figure 2:
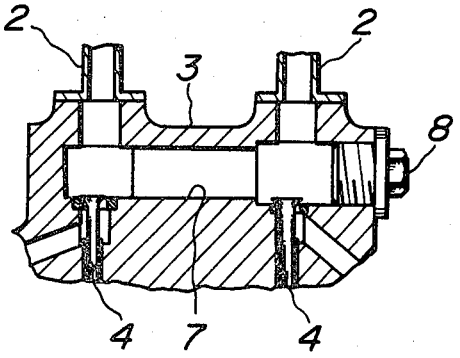
FIGS. 2 and 3 are schematic longitudinal sectional views of portions of steam engines, respectively, according to other embodiments of the present invention.

In the embodiment shown in FIG. 2, an opening 7 is formed in the cylinder head 3 adjacent the inlet valves 4, 4. The opening 7 communicates the steam feed conduits 2, 2 with each other, and forms a steam reservoir space having a predetermined volume adjacent to and common with the inlet valves 4, 4. The opening 7 is closed by a plug 8. The operation and effect of the opening 7 are substantially the same as those for the communication tube 5 shown in FIG. 1.

Figure 3:
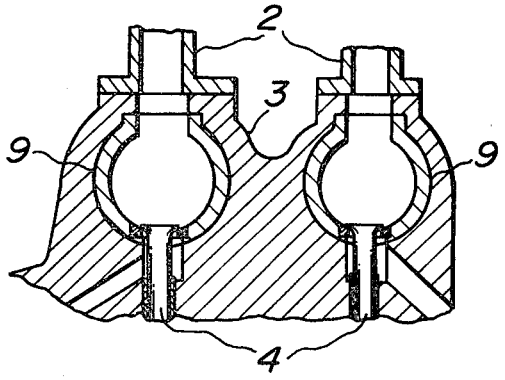

In another embodiment shown in FIG. 3, a steam reservoir 9 of suitable material is integrally cast in the cylinder head 3 and is in communication with each steam feed conduit 2 and each inlet valve 4. By selecting the volume of the steam reservoir 9 to be sufficiently large, throttle resistance in the feed conduit 2 is substantially decreased, and gas column vibration at the inlet of the inlet valve 4 can be suppressed.

It will be appreciated that, by forming a steam chamber of sufficient volume adjacent to the inlet valve 4, according to the present invention, pressure pulsation and gas column vibration at the inlet of the inlet valve are efficiently suppressed to thereby improve the steam charging efficiency. As this advantage can be obtained throughout the whole speed range of the engine, output of the engine can also be improved. In contrast to this, with a conventional resonance tube, the output can be improved only for a narrow range of the engine speed.

What is claimed is:

1. A multicylinder steam engine having an engine body for relatively movable connection with a steam generator through steam feed conduits, the steam feed conduits being connected with the cylinders of the engine, respectively, and a steam chamber of sufficient volume formed adjacent to each inlet valve of each cylinder and communicating with each steam feed conduit to suppress pressure pulsation in the conduit, the volume of the steam chamber being more than one half of the total displacement of the cylinders.

2. A steam engine as claimed in claim 1, wherein said steam chamber is formed as a communication tube which communicates two or more of said steam feed conduits with each other.

3. A steam engine as claimed in claim 2, wherein the communication tube is integrally cast into a cylinder head of the engine.

4. A steam engine as claimed in claim 3, wherein the communication tube consists of a material which is superior in heat and pressure resisting properties to the material forming the cylinder head.

* * * * *